US007339127B2

(12) United States Patent
Renner et al.

(10) Patent No.: US 7,339,127 B2
(45) Date of Patent: Mar. 4, 2008

(54) CONTACT PIECE MADE OF TUNGSTEN PROVIDED WITH A CORROSION-RESISTANT LAYER MADE OF A BASE METAL

(75) Inventors: Gerhard Renner, Dachau (DE); Udo Siefken, München (DE); Martin Müller, Ruhla (DE)

(73) Assignees: Louis Renner GmbH, Dachau (DE); Fer Fahrzeugelektrik GmbH, Eisenaugh (DE)

( * ) Notice: Subject to any disclaimer, the term of this patent is extended or adjusted under 35 U.S.C. 154(b) by 16 days.

(21) Appl. No.: 10/554,175

(22) PCT Filed: Apr. 19, 2004

(86) PCT No.: PCT/EP2004/004153

§ 371 (c)(1),
(2), (4) Date: Aug. 8, 2006

(87) PCT Pub. No.: WO2004/095485

PCT Pub. Date: Nov. 4, 2004

(65) Prior Publication Data

US 2006/0278507 A1 Dec. 14, 2006

(30) Foreign Application Priority Data

Apr. 22, 2003 (DE) ..... 103 18 223

(51) Int. Cl.
*H01H 1/021* (2006.01)

(52) U.S. Cl. ..... 200/262; 200/268; 200/269; 29/622

(58) Field of Classification Search ..... 200/262–270; 29/622, 874–880, 885; 428/929, 934–938
See application file for complete search history.

(56) References Cited

U.S. PATENT DOCUMENTS

| | | | | |
|---|---|---|---|---|
| 3,519,543 | A | 7/1970 | Gwyn | |
| 3,562,467 | A * | 2/1971 | Mooradian | 200/268 |
| 3,569,653 | A * | 3/1971 | Cockshutt | 200/267 |
| 3,697,389 | A * | 10/1972 | Jacobs et al. | 205/194 |
| 3,845,543 | A * | 11/1974 | Roth et al. | 228/190 |
| 3,852,879 | A | 12/1974 | Krock et al. | |
| 4,088,803 | A * | 5/1978 | Kubo et al. | 205/170 |
| 4,486,631 | A | 12/1984 | Naya et al. | |
| 4,680,438 | A * | 7/1987 | Witting et al. | 200/268 |
| 4,780,582 | A * | 10/1988 | Haessler et al. | 200/266 |
| 2003/0015347 | A1* | 1/2003 | Eldridge et al. | 174/260 |

FOREIGN PATENT DOCUMENTS

| | | |
|---|---|---|
| DE | 3232097 | 3/1984 |
| JP | 50111078 | 9/1975 |

OTHER PUBLICATIONS

Albert Keil, "Eine spezifische Korrosionserscheinung an Wokfram-Kontakten," Werkstoffe und Korrosion 7, pp. 263-265, (1952).
C.L. Meyer, "Korrosionserscheinungen an Unterbrecherkontakten," Elektropost 7, pp. 93-95, (1954).

* cited by examiner

*Primary Examiner*—Michael A Friedhofer
(74) *Attorney, Agent, or Firm*—Kagan Binder, PLLC

(57) ABSTRACT

A contact piece is formed by a tungsten overlay soldered onto a support, wherein at least portions of the solder layer and optionally of the support are covered by a layer of a less noble metal than tungsten. The corrosion resistance of the tungsten overlay is considerably improved.

12 Claims, 2 Drawing Sheets

Sn layer 11:1

11:1

11:1

CONTACT PIECE MADE OF TUNGSTEN PROVIDED WITH A CORROSION-RESISTANT LAYER MADE OF A BASE METAL

SUMMARY OF THE INVENTION

Due to its excellent burn-off resistance, of all high-melting metals tungsten is the metal of choice for use as a contact overlay in electromechanical switching devices whenever high switching sequences combined with considerable formation of sparks are at issue. Provided that the contact force is sufficiently high and a minimum switching voltage is given, tungsten contact pieces may be used free of trouble in various switching devices such as motor vehicle contact breakers, motor vehicle horns and relays. As a rule, the contact piece is manufactured as a rivet comprising a tungsten plate as a contact overlay soldered onto a rivet-shaped support made of soft iron or copper (cf. FIG. 1).

Tungsten, however, is no noble metal. When switching is performed under air, oxidic coatings are to be expected at the surface. The formation of corrosion on tungsten contact pieces has been known to pose a problem for more than 50 years and under unfavourable switching conditions impairs the universal applicability of tungsten as a contact material. Under dry air and in hot environment (desert climate) the tungsten contact will remain unimpaired and fully functioning for a long period of time. If, however, the surroundings are accompanied by humidity (tropical climate), rapid corrosion of the unprotected tungsten will result.

The circumstances and effects of the formation of corrosion are described in the following publications:

Keil, A.: Eine spezifische Korrosionserscheinung an Wolfram-Kontakten. Werkstoffe und Korrosion 7 (1952) 263-265.

Keil, A.: Meyer, C. L.: Korrosionserscheinungen an Unterbrecherkontakten. Elektropost 7 (1954) 93-95.

Vinaricky, E et al.: Elektrische Kontakte, Werkstoffe und Anwendungen, Berlin 2002, p. 178.

The publications report on contact malfunctions due to released organic substances, in particular under tropical conditions.

Recently, intense research has been conducted with respect to malfunctions with fanfares and signal horns in the motor vehicle supply sector due to corrosion of the contact pieces. The same applies to electromechanical relays the forerunning or main contacts of which are coated with tungsten.

Under warm and humid climate, tungsten contact assemblies tend to fail increasingly. This can be observed in a statistically striking way with horn contacts if, e.g., prior to launching the sales of a new motor vehicle type a specific number of motor vehicles is produced for the storage yard, possibly left to stand there for months under warm and humid conditions before being delivered to the customer via the car dealer.

In case a horn ceases to operate, upon opening the piece complained about, a thick oxide layer of tungsten oxide and tungstates often becomes apparent on and between the closed tungsten contact pieces. Due to this intermediate layer, the contacts become separated, the contact resistance gets high, the horn ceases to operate. Numerous efforts have been made to remedy this defect which is annoying to the customer and costly for the manufacturer:

A method generally known to the skilled person is to coat the entire contact rivet with a thin nickel layer prior to incorporating it into the switching device. Due to the passivation of nickel, the switched-off contact remains clean and free of corrosion layers for a long time if the nickel layer is intact. However, due to the necessary testing of the new horn at the horn manufacturer's, the Ni layer is partly destroyed at the switching surface. The protective effect of the Ni layer decreases considerably. In a field test, a positive effect of nickel-plating cannot be clearly proven any longer.

Another possibility would be to carburize the tungsten switch surface. A tungsten carbide-containing hard layer some μm in thickness is formed. Without any doubt such a hard layer shows increased corrosion resistance.

Japanese patent publication 20128/1974 discloses the use of graphite powder as a carburizing agent.

German laid-open publication 3232097 A1 discloses the use of propane as a carburizing agent in the controlled-atmosphere furnace. In this context, an impairment of the solder side of the tungsten contact overlay by the concurrent undesired carburization as well as an impairment of the heating conductors of the furnace cannot be ruled out.

Moreover, in both methods the thin protective layer is destroyed by switching the horn on and the free tungsten in turn is exposed to the surrounding atmosphere without protection.

The preparation of such layers is costly and requires additional working steps, thus making it too expensive. In practice, tungsten contacts comprising hard layers could not prove themselves successful.

Further attempts to improve the corrosion resistance of tungsten contact rivets consisted in silver-plating the contact rivet or in using a soldering metal having a high silver content (thus, being a more noble metal) instead of the common copper solder.

These methods were also only used sporadically and did not bring about a drastic improvement in corrosion resistance.

Thus, the object underlying the invention is to develop a contact piece consisting of a tungsten overlay soldered onto a metallic support by means of a Cu or Ag hard soldering metal, which contact piece does not exhibit impaired switching properties under corrosive conditions, in particular under the influence of a warm and humid climate.

This object was solved by the surprising finding that by covering the solder layer and the support with a thin base metal layer, the corrosion resistance of the tungsten overlay can be considerably improved.

Thus, the subject matter of the invention is a contact piece comprising a tungsten overlay (1), the solder (2) and support (3) of which are coated with a thin layer (4) of base metal.

Preferred embodiments of the rivet are wherein the layer of the less noble metal of the contact piece is 0.1 to 20 μm thick, or preferably wherein the layer of the less noble metal is 0.2 to 2 μm thick. In another preferred embodiment, the less noble metal of the contact piece is Sn, Zn, Mg or Al, and particularly preferably the less noble metal is Sn. A method for the preparation of the contact piece comprises applying a layer of a less noble metal than tungsten (also described herein as a "base metal") onto the contact piece. If there is any less noble metal present on the tungsten overlay, that portion of the less noble metal can be removed. The layer of a less noble metal in a preferred embodiment can be applied via electroplating. In a preferred embodiment, the less noble metal can be applied selectively onto the solder and the metallic support. If there is any less noble metal present on the tungsten overlay after application, that portion of the less noble metal can be removed in a preferred embodiment by sliding grinding.

As base metals according to the invention those metals may be considered which under operating conditions in the electrochemical series are more negative than tungsten. Preferred examples are tin, zinc, magnesium and aluminium, tin (Sn) being particularly preferred. With respect to the electrochemical series, tin differs only slightly from tungsten. However, in practice tin has proven to be particularly suitable. What is to be emphasized in connection with a galvanic deposition of Sn is that the latter is a method which can be carried out at a very reasonable price and gives an esthetically attractive result.

The inventive solution is advantageous in that in the switching contact the burn-off material tungsten is free of any protective/foreign layer and, thus, the latter can neither be destroyed by the formation of sparks nor other disturbing influences upon switching have to be reckoned with. The effect of the base metal layer is not achieved via physically covering the tungsten to be protected, but is merely achieved by electrochemical means.

The inventors assume that by the formation of a local galvanic element under the inclusion of a liquid film on the respective surface, the less noble metal (Sn, Zn, Mg or Al) preferably dissolves under the present potential ratios for the benefit of the more noble tungsten.

If more noble elements such as copper (as a Cu solder) or Ag (as an electrolytic cover) form a local galvanic element with W, the tungsten of the W-contact overlay will preferably dissolve as the so-called sacrificial anode. In view of the formation of a local galvanic element, Ag as a protective layer is counterproductive and copper as an adjacent solder layer even promotes corrosion. The same presumably applies to Ni which due to the displacement in potential behaves cathodically, i.e. more noble.

DETAILED DESCRIPTION

The following non-limiting examples illustrate some preferred embodiments of the invention:

EXAMPLE 1

Contact rivets comprising a tungsten overlay 4 mm in diameter and 0.8 mm in thickness, soldered with Cu solder onto nickel-plated iron supports, are provided with an Sn layer 0.2 to 2 μm in thickness which is applied galvanically. Subsequently, the tin only loosely adhering to the tungsten surface is removed mechanically by means of sliding grinding. The thus ready-to-supply contact rivets are subjected to a constant climate in the corrosion test: 48 h at 96% relative humidity and 50° C. During this test, about 20 pieces of the rivets provided with a tin layer as described above and exhibiting an exposed tungsten surface on a porcelain support are introduced into an exsiccator. The bottom of the exsiccator contains a saturated potassium sulfate solution on top of which the relative humidity is adjusted to 96%. On a separate porcelain support rivets in accordance with the prior art—without any additional galvanic base metal layer—are added as a reference. The exsiccator is temperature-controlled in a climatic test cabinet for 48 h at constant 50° C.

Figure 1:
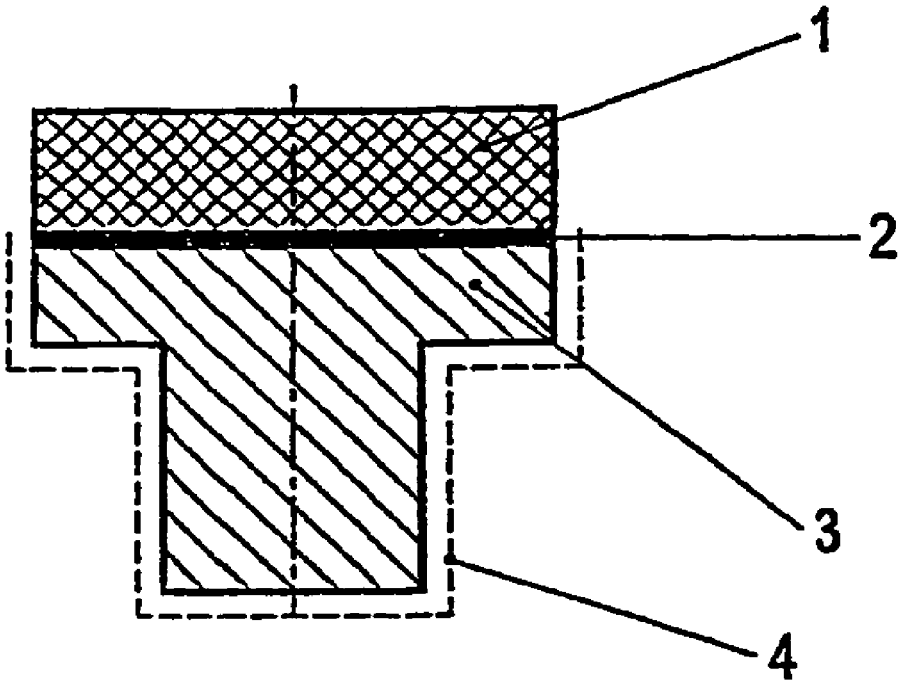
FIG. 1 (schematically) depicts a contact piece for use as a horn and relay contact which consists of a tungsten contact overlay (1), soldered by means of Cu or Ag hard solder (2) onto a metallic support (3) which according to the invention is covered with a base metal layer (4).
Figure 2:
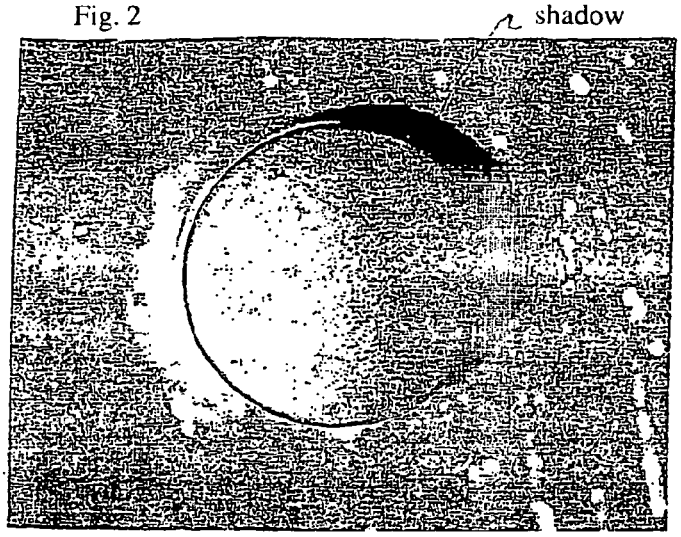
FIG. 2 depicts a contact overlay made of W on a rivet base, galvanically protected with 0.5 to 1 μm of an Sn layer after corrosion testing.
Figure 3:
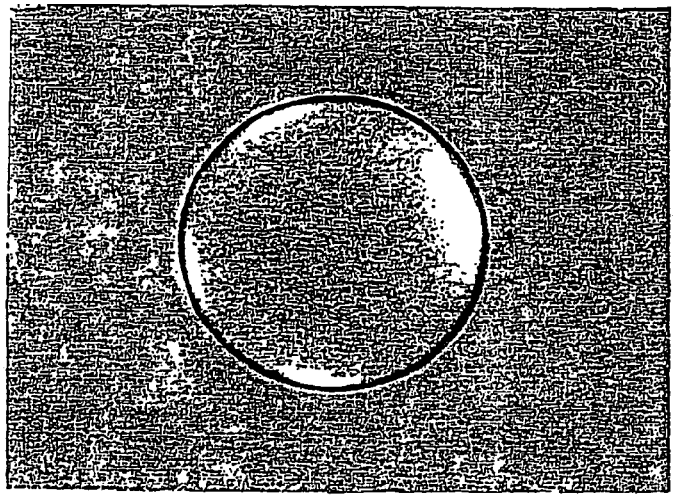
FIG. 3 depicts a contact overlay made of W of a rivet in accordance with the prior art as a reference prior to corrosion testing.
Figure 4:
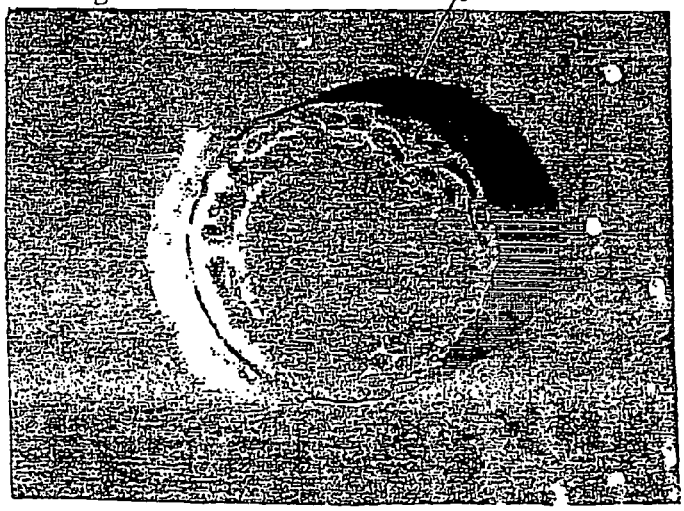
FIG. 4 depicts a contact overlay made of W of a rivet in accordance with the prior art after corrosion testing.

The result after 48 hours is depicted in FIGS. 2 and 4. As compared with the non-corroded standard (FIG. 3), the galvanically after-treated rivets show only slight haziness at the contact surface. As regards the reference without galvanic after-treatment, however, the W-surface is covered with thick greenish-brown crusts which, starting from the periphery at the Cu solder, extend into the tungsten surface, in part up to its center. These crusts are probably inorganic salts of copper and tungsten. If these are located between the closed contacts of a horn, this will result in an increased contact resistance and, consequently, the break down of the horn.

EXAMPLE 2

The experimental setup is the same as in Example 1. Instead of Sn, Zn is used as an additional galvanic layer. The comparison with an untreated standard gives similar results as in Example 1. What is disadvantageous here is that the zinc-plated support shows a bluish tarnish upon corrosion. The rivets become unsightly.

The base metals Al and Mg show a similar behavior as Sn and Zn. The application of the galvanic layers, however, is somewhat more difficult and costly with these metals.

The invention claimed is:

1. A contact piece comprising a tungsten overlay (1) soldered onto a metallic support (3) by a solder layer (2), wherein at least portions of the solder layer (2) and optionally the support (3) are covered by a layer of tin (4).

2. The contact piece as claimed in claim 1, wherein the layer of tin (4) is 0.1 to 20 μm thick.

3. The contact piece as claimed in claim 2, wherein the layer of tin (4) is 0.2 to 2 μm thick.

4. A horn comprising the contact piece of claim 1.

5. An electromechanical switching device comprising the contact piece of claim 1.

6. A method of manufacture of a horn, comprising assembly of horn components that include the contact piece of claim 1.

7. A method of manufacture of an electromechanical switching device, comprising assembly of electromechanical switching device components that include the contact piece of claim 1.

8. A method for the preparation of a contact piece as claimed in claim 1, comprising a) providing a contact piece comprising a tungsten overlay (1) soldered onto a metallic support (3) by a solder layer (2); and b) applying a layer of tin onto the contact piece in a manner so that the layer of tin does not physically cover the tungsten to be protected.

9. The method as claimed in claim 8, wherein the layer of tin is applied via electroplating.

10. The method as claimed in claim 8, wherein the layer of tin is applied selectively onto the solder and the metallic support.

11. The method as claimed in claim 8, wherein the tungsten is initially covered by the layer of tin, and then is re-exposed by a subsequent step of removal of the layer of tin.

12. The method as claimed in claim 11, wherein the tungsten is re-exposed by a sliding grinding step.

* * * * *